United States Patent [19]

Cecere

[11] 4,173,812

[45] Nov. 13, 1979

[54] APPARATUS FOR CALENDERING TUBULAR KNITTED FABRICS

[75] Inventor: Andrew P. Cecere, Valley Stream, N.Y.

[73] Assignee: Samcoe Holding Corporation, Woodside, N.Y.

[21] Appl. No.: 834,514

[22] Filed: Sep. 19, 1977

[51] Int. Cl.[2] ..... D06C 5/00

[52] U.S. Cl. ..... 26/84

[58] Field of Search ..... 26/80, 81, 83, 84, 85

[56] References Cited

U.S. PATENT DOCUMENTS

| | | | |
|---|---|---|---|
| 231,270 | 8/1880 | Case et al. | 26/81 X |
| 1,790,655 | 2/1931 | Cohn | 26/84 |
| 2,189,166 | 2/1940 | Cohn et al. | 26/83 X |
| 2,222,794 | 11/1940 | Cohn et al. | 26/85 |
| 2,339,151 | 1/1944 | Cohn et al. | 26/83 |
| 2,583,630 | 1/1952 | Chatfield | 26/84 X |
| 3,126,606 | 3/1964 | Beard | 26/83 |
| 3,195,213 | 7/1965 | Wehrmann | 26/83 X |
| 3,332,124 | 7/1967 | Beard | 26/83 X |
| 3,762,003 | 10/1973 | Frezza | 26/81 |
| 3,883,935 | 5/1975 | Catallo et al. | 26/83 |
| 3,909,890 | 10/1975 | Frezza | 26/81 |
| 3,973,304 | 8/1976 | Catallo | 26/84 |
| 3,973,305 | 8/1976 | Catallo | 26/81 |
| 3,973,306 | 8/1976 | Catallo | 26/81 |

FOREIGN PATENT DOCUMENTS

| | | | |
|---|---|---|---|
| 1181847 | 1/1959 | France | 26/80 |
| 242734 | 11/1925 | United Kingdom | 26/84 |

*Primary Examiner*—Robert Mackey

*Attorney, Agent, or Firm*—Mandeville and Schweitzer

[57] ABSTRACT

The disclosure relates to an apparatus for finishing of tubular knitted fabric including means for laterally distending the fabric to flat, two-layer form by passing it over a spreader frame, and discharging the fabric from the spreader frame into a pair of opposed calendering rolls. Improved arrangements are provided for engaging the tubular fabric, across its fully spread width, above and below the spreader, for independently advancing or retarding the respective layers of the fabric in order to bring them into proper alignment. The improved arrangements include a thin, flat contact plate, incorporated into the spreader frame structure, which provides a contact support for the fabric, enabling it to be drivingly engaged by independently driven contact rolls. The structure of the invention enables the fabric to be adjusted substantially across its full width, reducing to a practicable minimum areas at the extreme edges of the fabric tube that are not under positive control during the adjustment stage. The apparatus also includes an improved entry guard arrangement, which facilitates the machine operator's attendance to the equipment and process while improving working conditions from a safety standpoint.

13 Claims, 12 Drawing Figures

APPARATUS FOR CALENDERING TUBULAR KNITTED FABRICS

BACKGROUND AND SUMMARY OF THE INVENTION

In the processing of tubular knitted fabric, finishing procedures typically include passing the tubular knitted fabric over a suitable spreader frame, to distend the fabric to a predetermined, uniform width and to convert the fabric to a flat, two-layer form. The fabric is continuously advanced over the spreader and, while in the flattened and distended condition, is steamed, permitting geometric adjustment of the fibers and stitches to stabilize the fabric in its uniformly distended condition. The fabric is then immediately discharged into a pair of calendering rolls, which, in effect, press the fabric, smoothing and further stabilizing it. After calendering, the fabric is gathered, typically by rolling or folding, and is taken away for cutting.

For many end uses, and particularly where the fabric is of a striped construction, it is important that the top and bottom layers of the two-layer fabric be in proper alignment or registration. Otherwise, distortions will appear in the fabric, which may be carried over into the garments which are ultimately made therefrom. Various techniques have been proposed and practiced for effecting relative adjustment of the top and bottom layers. One early and widely used technique is reflected in the S. Cohn et al. U.S. Pat. No. 2,222,794, and this involves the use of adjustable diverter bars, which enable one layer of the fabric to be diverted and/or retarded relative to the other, to bring the two layers of fabric into better alignment. Proposals have also been made for independently driving portions of the upper and lower fabric layers by variable speed rollers, in an effort to provide a greater range of adjustability. Prior proposals for such arrangements have had serious shortcomings, however, in that the independently driven rollers engage the fabric in cooperation with other rolls mounted on the spreader frame and positioned internally of the fabric. Because of the inherent bulkiness of such internal rolls, and the provisions for the support thereof, there are substantial margins of the fabric, adjacent the edge extremity, which cannot be effectively engaged by the independently driven rolls. As a result, these substantial margins may be difficult to adjust, and the finished fabric may contain significant irregularities along these margins.

In accordance with the invention, improved arrangements are provided which enable the upper and lower surfaces of the distended fabric to be controllably driven, substantially across the full distended width of the fabric, reducing to a practical minimum side edge margins which are not subject to control. Pursuant to this aspect of the invention, the spreader is provided, in its upstream portion, with a thin, flat contact plate, which may be virtually as thin as the upstream portion of the spreader frame. The contact plate is positioned in cooperating relation to upper and lower contact rolls, which extend across the full width of the machine. When the spreader frame is in position, and fabric is passing over it, the respective upper and lower layers of the fabric are grippingly engaged between the contact plate and the respective contact rolls. The presence of the contact plate does not distort the fabric, and control engagement of the fabric, out to its edge extremity, is made possible.

In accordance with another aspect of the invention, an improved calendering arrangement is provided, having the features and characteristics mentioned above, which readily accommodates lateral adjustment of the spreader frame. To this end, the spreader frame incorporates a substantially full width contact plate, which is adjustably mounted at its opposite sides in the spreader frame to accommodate a limited range of adjustment. A limited number of contact plates may be provided, to encompass the full range of width adjustment of the equipment, while at the same time providing in all cases substantially full width control over the fabric in the adjustment stage.

In accordance with another feature of the invention, an improved guard arrangement is provided, for cooperation with the upstream end of the spreader, in the region of the contact rolls. The guard arrangement is linked with the contact rolls in an advantageous manner, such that when the contact rolls are opened sufficiently to enable a new fabric section to be threaded into the equipment, the front guard automatically opens wide to provide manual access. When the contact rolls subsequently are moved into operating positions, the guard means automatically move into position to preclude access to the nip area of the contact rolls.

For a more complete understanding of the above and other features and advantages of the invention, reference should be made to the following detailed description of a preferred embodiment and to the accompanying drawings.

DESCRIPTION OF PREFERRED EMBODIMENTS

Figure 1:
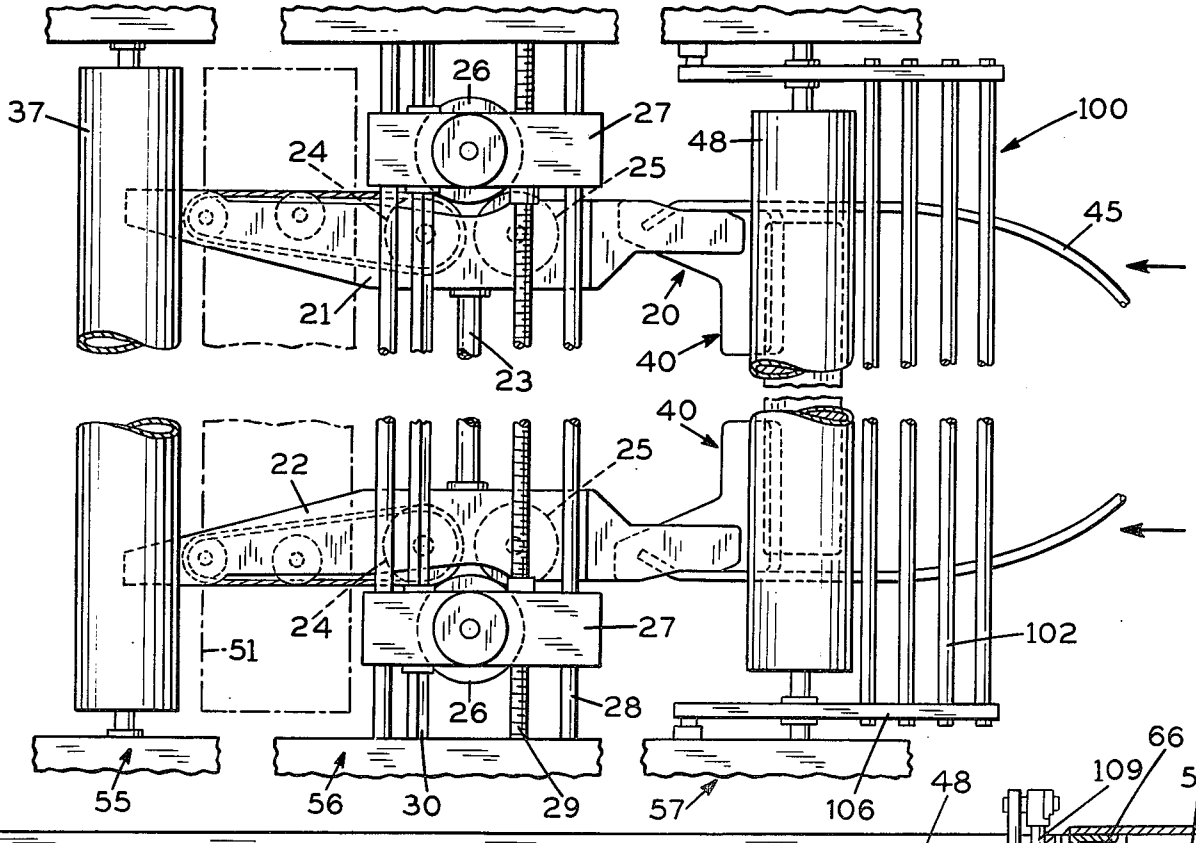
FIG. 1 is a top plan view illustrating an apparatus according to the invention for the finishing of tubular knitted fabric.
Figure 7:
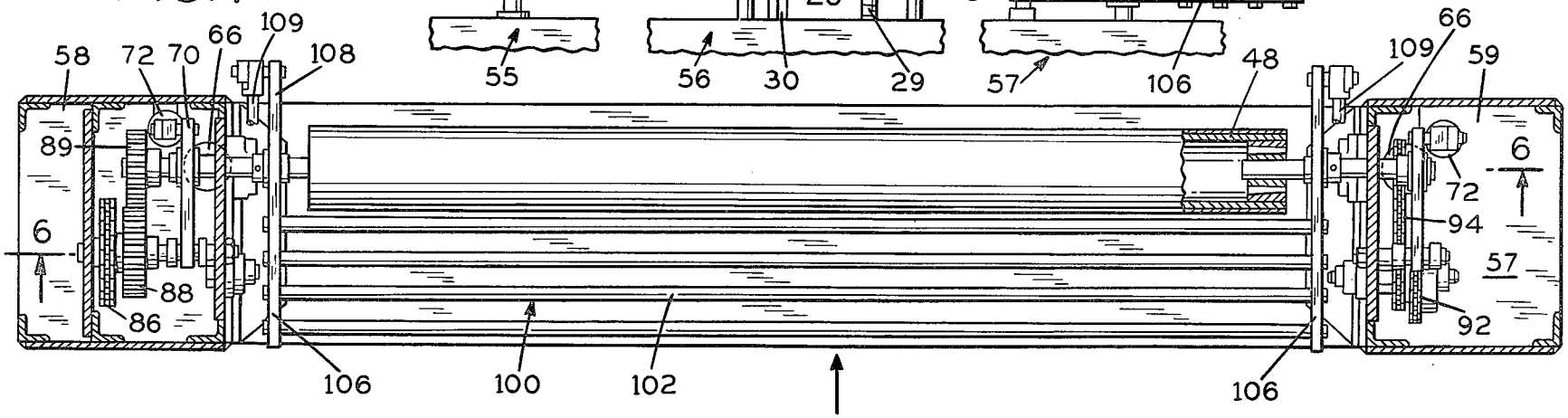
FIG. 7 is a cross sectional view as taken generally along line 7—7 of FIG. 6.

Referring now to the drawings, and initially to FIG. 1 thereof, the reference numeral 20 designates generally a spreader frame for receiving tubular knitted fabric. The spreader 20 includes opposite side frame members 21, 22 connected by a length-adjustable spacer rod 23. Symmetrically arranged with respect to the spacing rod 23 are pairs of rolls 24, 25 which are arranged in a well known manner to be engaged and supported by edge drive rolls 26 at each side. The edge drive rolls typically are of concave peripheral contour, for engagement with convexly contoured frame rolls 24, 25 such that, when the frame 20 is properly positioned between and in contact with the edge drive rolls 26, the frame is supported vertically, as well as positioned horizontally by the edge drive rolls.

Conventionally, the edge drive rolls are journaled on carriages, which are slideably supported by guide rods 28 for lateral adjustment by means of a threaded shaft 29. A splined drive shaft 30 is driven by means (not specifically shown) for operating the edge drive rolls 26, and hence the spreader frame rolls 24, 25, at controllably adjustable speeds.

The downstream section of the spreader frame 20, that is the section to the left of the edge drive rolls in FIG. 1, comprises a pair of frame plates 31, 32 (see FIGS. 2 and 3) which mount belt guide rollers 33, 34. Belts 35 are supported and guided by the rollers 33 and 34 and also by the downstream spreader rolls 24, such that the belts 35 are driven synchronously with the spreader rolls 24, by means of the edge drive rolls 26, in a known manner. As shown particularly in FIG. 3, the outside regions of the belts 35 lie slightly outside the recessed edges of the frame plates 31, 32, such that the belts form the edge extremities of the spreader in the downstream section. Accordingly, when the frame is positioned by the edge drive rolls 26, and the latter are driven to rotate, the belts 35 are driven in a direction to advance fabric over the downstream section of the spreader frame toward the discharge end 36 thereof. The discharge end 36 is tapered to a fairly thin section, and is normally positioned between an opposed pair of calender rolls 37, 38, so as to discharge fabric directly into the nip 39 thereof.

Figures 2, 3, 4, 5:
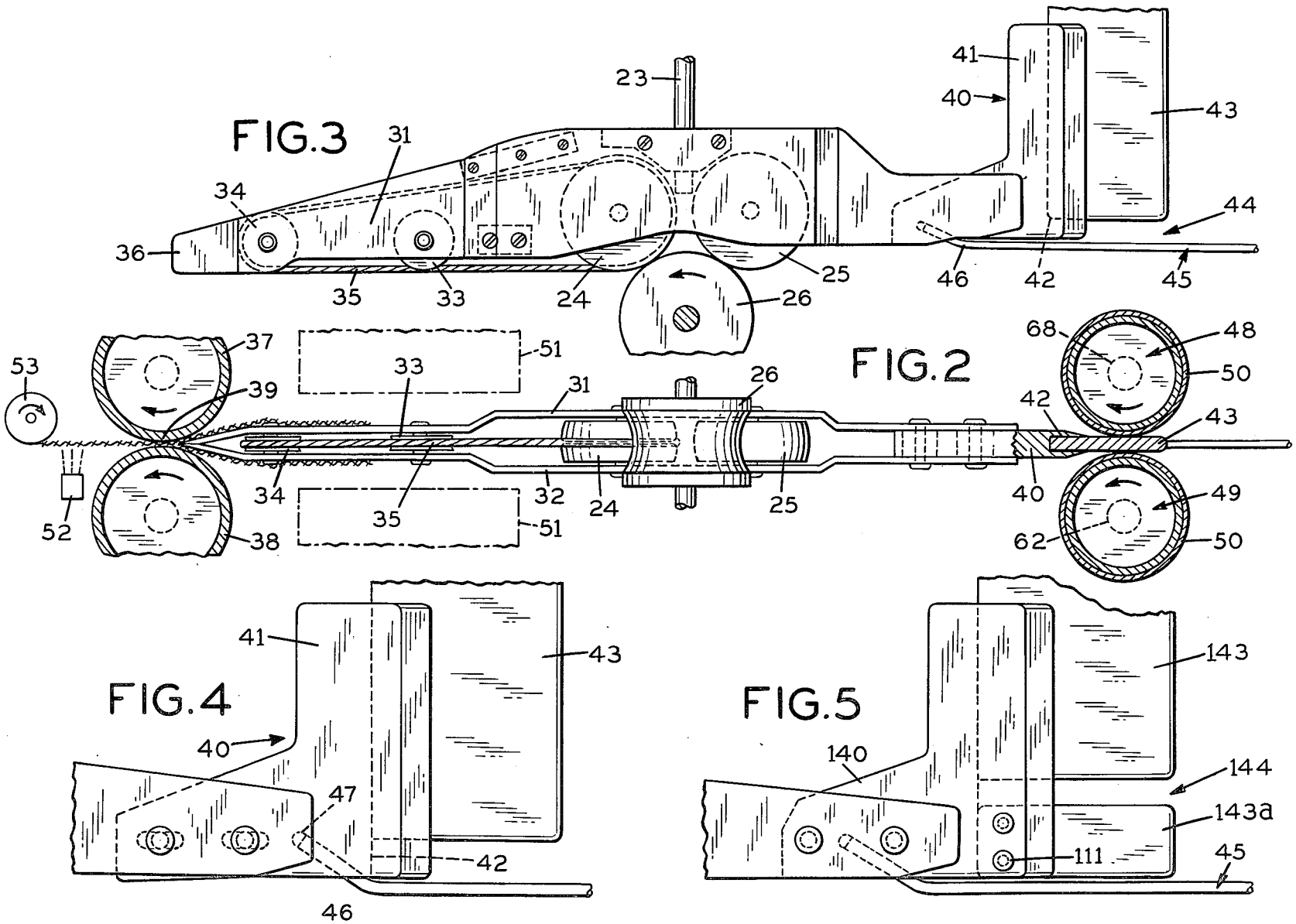
FIG. 2 is a schematic side elevational view of the apparatus of FIG. 1.
FIG. 3 is a fragmentary top plan view showing details of the spreader frame apparatus illustrated in FIG. 2.
FIGS. 4 and 5 are enlarged fragmentary plan views illustrating details of the arrangement for mounting a flat contact plate in the spreader apparatus of FIGS. 2 and 3.
Figure 6:
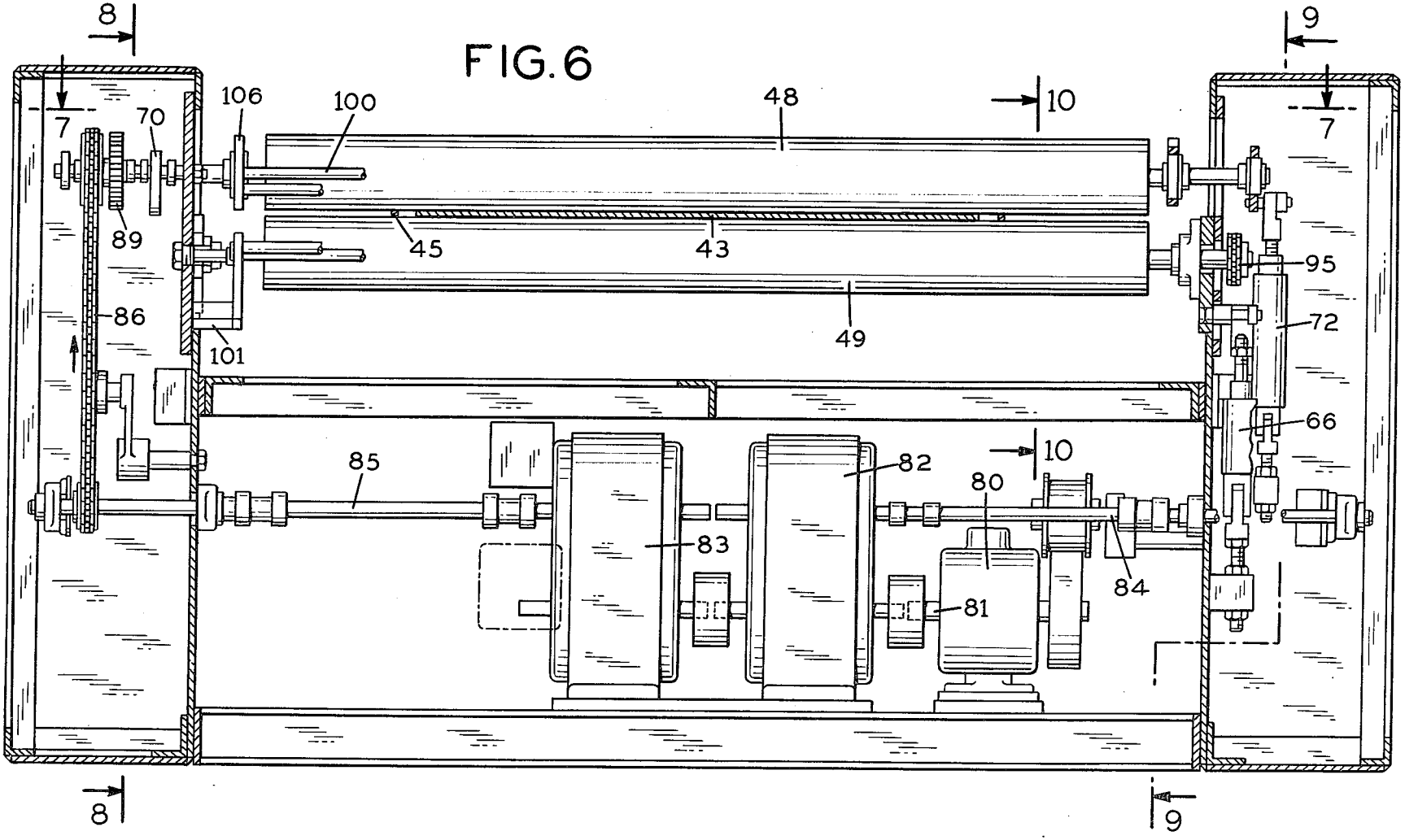
FIG. 6 is a cross sectional view as taken generally along line 6—6 of FIG. 7.

As reflected in FIG. 2, the spreader frame 20 has its greatest thickness in the area of the edge drive rolls 26, where the frame plates 31, 32 are separated sufficiently to straddle the spreader rolls 24, 25. Upstream of the spreader rolls, the frame plates 31, 32 are converged to a narrower dimension and rigidly mount a plate-supporting bracket 40 at each side. The brackets 40 may be generally of an L-shaped configuration, including transversely extending plate-supporting arms 41. The plate-supporting arms 41 are formed with a transverse recess 42 arranged to receive and frictionally retain a flat, thin, transversely extending contact plate 43. The plate-supporting arms 41 typically are rather short in relation to the overall width of the assembled spreader. The contact plate 43, on the other hand, extends across substantially the full width of the spreader, being supported at its end extremities within the recess 42 of each supporting arm 41.

As reflected in FIG. 3, for example, the width of the contact plate 43, in the upstream-downstream direction, is substantially greater than the depth of the recess 42, such that a substantial portion of the contact plate projects upstream from the mounting brackets 40. Although the invention is not in any sense limited to particular dimensions, a representative practical embodiment of the invention illustrated in FIGS. 1 and 3 may incorporate plate-mounting brackets 40 having a thickness of about 20 mm, mounting a contact plate 43 whose thickness typically may be less than 10 mm. The forward extremities of the plate-receiving portions 41 advantageously are tapered substantially down to the thickness of the contact plate 43. Likewise, in a machine having an overall width capacity of about 127 cm (in the downstream stage of the spreader). The arm portions 41 of the plate-mounting brackets might typically have a length of as little as 15 cm, whereas the contact plate 43 itself extends entirely across the spreader frame, from one bracket 40 to another, having an overall transverse length of, for example, somewhat in excess of 100 cm. In this respect, the upstream portion of the spreader frame typically is about the same width as the downstream section and, in the example, might have an overall upstream width of around 110 cm. For some applications, the upstream section may advantageously be slightly narrower than the downstream section.

In accordance with one aspect of the invention, the transverse length of the contact plate 43 may be of the same as the width of the upstream portion of the spreader, but more desirably is slightly (e.g. 5 cm) less, leaving a small space (e.g. 2.5 cm) at each side, as indicated at 44 in FIG. 3. This provides for a limited amount of width adjustment of the spreader frame, with a contact plate of fixed size, the plate 43 being slideable in the recess 42 to accommodate a limited relative movement. In practical application, in order to keep the size of the gap 44 as narrow as practicable, a separate plate 43 may be provided for each 5 cm range of adjustment over the full adjustable capacity of the equipment. However, the number of plates provided may be somewhat greater or somewhat less, depending upon the production requirements to be satisfied.

In the illustrated form of the invention, there is attached to the plate-mounting brackets 40 at each side a generally U-shaped, wire entry frame 45, which forms the upstream end extremity of the spreader frame and serves as a lead-in for the oncoming fabric. At each side, the entry frame 45 is provided with an inwardly angled end portion 46 snugly received in a recess 47 drilled in the mounting bracket 40. The entry frame 45 is relatively resilient, and a single wire will accommodate a substantial range of lateral adjustment of the spreader frame. However, it may be desirable to provide more than one size of entry frame member 45 to cover the full range of adjustment of the equipment.

Pursuant to an important aspect of the invention, upper and lower contact rolls 48, 49 are journaled in the machine frame, by means to be later described, directly above and below the contact plate 43. The contact rolls extend the full width of the machine, so as to cooperate with a contact plate 43 of the largest size accommodated by the equipment. As reflected in FIG. 2, the contact rolls 48, 49, when in operative position, have their surfaces closely adjacent the respective upper and lower surfaces of the contact plate. In general, ideal adjustment of the equipment would provide for a very small (i.e., less than the thickness of a layer of fabric) clearance between the contact plate and the rolls, although very light touching of one or the other of the rolls, when no fabric is in the machine, is not harmful. The outer surfaces 50 of the contact rolls desirably are comprised of a suitable resilient material having good frictional characteristics with fabric, and the arrangement is such that, when a section of tubular knitted fabric is being advanced over the spreader frame, the respective upper and lower layers of the fabric are drivingly gripped between the respective contact rollers 48, 49 and the intervening contact plate 43. The upper and lower surfaces of the contact plate, at least in the region immediately opposing the rolls 48, 49, are very smooth, to accommodate the free sliding movement of the fabric layer over the contact plate, under the driving influence of the rollers 48, 49. As reflected in FIG. 2, the wire, forming the entry frame 45, is of relatively small diameter, so as to be in no event of greater diameter than the thickness of the contact plate 43. The latter may be as thin as is structurally practicable, consistent with reasonable durability under factory conditions.

In normal operation of the equipment of FIGS. 1–4, dry tubular knitted fabric is advanced over the upstream end of the wire entry frame 45. The fabric then passes over the contact plate 43, between the contact rollers 48, 49, and is carried over the spreader frame by the driving action of the spreader frame rollers 24, 25, the edge drive rollers 26, and the spreader belts 35. While being advanced over the downstream end of the spreader frame, the fabric is steamed, as by means of steam boxes 51, which may be of the type illustrated in the S. Cohn U.S. Pat. No. 2,602,314. The steamed fabric is then discharged from the spreader, directly into the calendering rolls 37, 38, where it is subjected to rolling pressure in the nip 39 and then discharged and gathered by rolling or folding.

Precise and effective control over the strips or cross lines in the tubular fabric, on the respective upper and lower faces thereof, is enabled by providing independent speed control of the contact rollers 48, 49, in relation to each other and to the edge drive rolls 26, as well as variable control of the calender rolls with respect to the edge drive rolls. Thus, the rolls 48, 49 may be independently advanced or retarded in relation to the edge drive rolls, and to each other, so that the cross lines of the fabric on the top may be adjusted forwardly or rearwardly relative to the cross lines on the bottom, and the center portions of the fabric may be effectively advanced or retarded, as needed, in relation to the side edges of the fabric.

Variable adjustment of upper and lower contact rollers is, of course, per se known. However, the system of the present invention provides for significantly superior results in relation to those heretofore obtainable, as a result of the thin, flat, contact plate 43, which extends substantially the full width of the spreader frame and affords continuous driving contact between the rolls 48, 49 and the fabric, across the full width of the fabric, except for a narrow gap 44 at the edge extremity, which will exist except at one extreme of the adjustment range of the setup. Thus, at one limit condition of adjustment, the sides of the wire entry frame 45 are substantially engaged with the end edges of the contact plate 43, such that there is no significant gap 44. At the opposite extreme of the adjustment range, the gap 44 may be on the order of 2 to 3 cm, still extremely small by comparison to equipment of more conventional construction. The contact plate 43, being rather thin in relation to the thickness of the spreading equipment overall, and desirably substantially less in thickness than the maximum thickness of the spreader frame, permits the fabric to have an extremely flat cross sectional configuration in the area of the contact rolls 48, 49. This not only reduces to a practical minimum the size of any gap 44 at the side edge, but also minimizes distortions in these unsupported edge margins of the fabric. Accordingly, a far greater degree of geometric uniformity in the processed fabric is obtainable in accordance with the invention than is possible with the known prior art.

In typical operation of the process, the speed of the calender rolls will be set in relation to the speed of the edge drive rolls (machine speed) so that the fabric is rather loose (free of length tension) in the downstream section, but not so loose as to pleat in the calender nip. A machine operator can easily observe the condition of the upper layer of the fabric, as it passes over the downstream portion of the spreader and as it emerges on the downstream side of the calender rolls 37, 38. If the cross lines of the fabric exhibit any forward bow, the speeds of the upper and lower contact rollers 48, 49 may be slightly decreased in relation to the edge drive rolls to pull back on the bow and straighten the cross lines. Correction of the lower fabric layer may be facilitated by viewing the same over a light source 52 and/or by means such as uprolling of the calendered fabric, as indicated at 53, in order to make the bottom layer of fabric conveniently visible.

In the illustrated form of apparatus, the basic segments of the apparatus are mounted on primary frame sections 55, 56, 57 (FIG. 1) which are structurally interconnected. At the upstream end of the installation, the primary frame section 57 includes means for mounting and driving the contact rolls 48, 49, and also an improved and simplified form of guard arrangement, to protect against accidental entry of foreign objects into the nip area of the contact rolls 48, 49. These features are shown particularly in FIGS. 6–12 of the drawing. Frame pillars 58, 59, forming part of the primary frame section 57, are mounted at each side of the machine and include mounting plates 60, 61. The lower contact roll 49 has supporting shafts 62 at each end, which project through vertically elongated openings 63 in the mounting plates and are journaled in arms 64 pivoted at 65 on the mounting plate 60 or 61. The mounting arms 64 are connected to actuating cylinders 66, which are anchored at 67 on the machine frame. The actuator 66 have a limited range of movement and, when fully extended, raise the lower contact roll 49 into a preadjusted, closely opposing relation to the lower surface of the contact plate 43. Means are provided for adjusting the fully extended position of the actuator 66, typically this may be incorporated in the anchoring structure 67, such that the fully raised position of the contact roll 49 may be precisely adjusted in relation to the contact plate.

The upper contact roll 48 is carried by a shaft 68, passing through an arcuately elongated slot 69 in the mounting plates 60 or 61 and supported by mounting levers 70 pivoted at 71. The levers 70 are connected to hydraulic actuators 72 having a predetermined range of extension, and being adjustably anchored at 73 such that the position of the actuator rods in the retracted condition may be accurately adjusted, to properly locate the upper contact roll 49 in relation to the plate 43 in the closed position of the roll.

Figure 8:
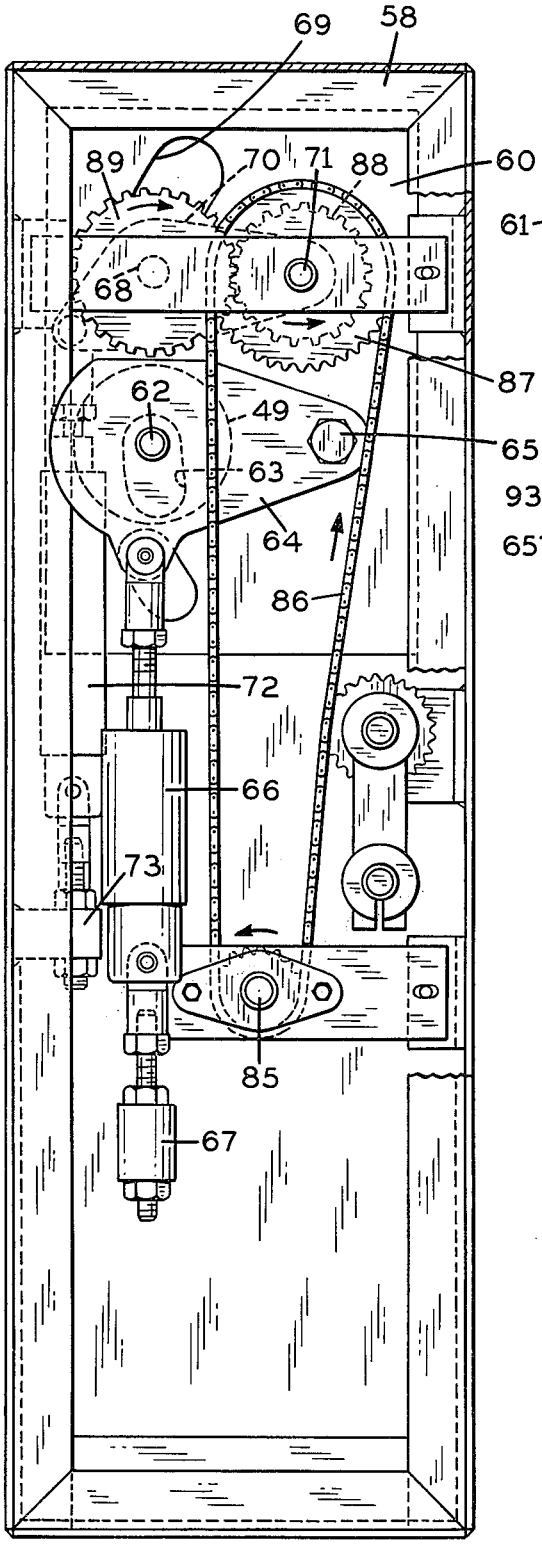
FIGS. 8-10 are cross sectional views as taken generally along lines 8—8, 9—9 and 10—10 respectively of FIG. 6.
Figure 9:
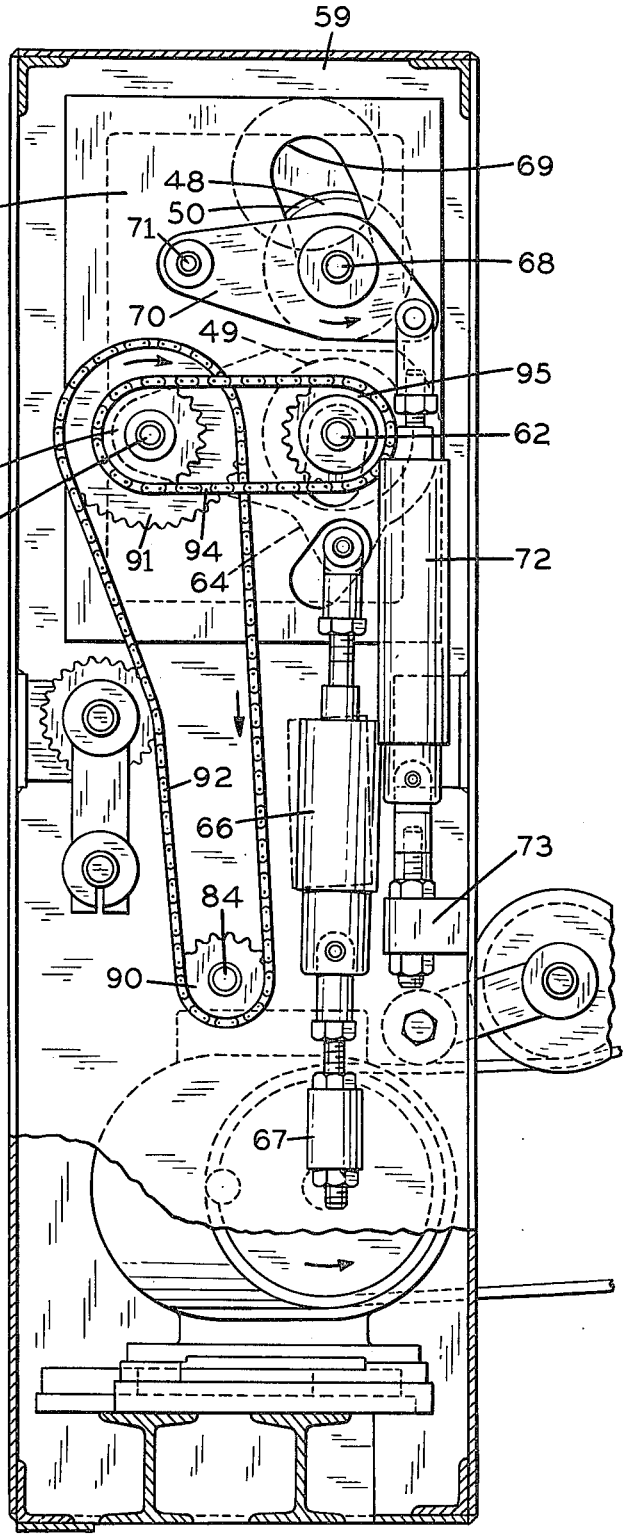
Figure 11:
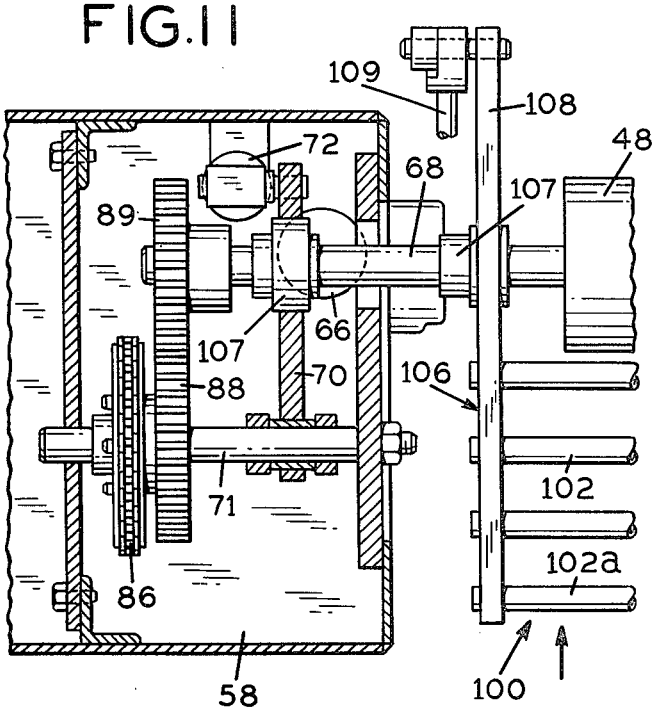
FIGS. 11 and 12 are fragmentary cross sectional views as taken generally along lines 11—11, 12—12 respectively of FIG. 10.
Figure 12:
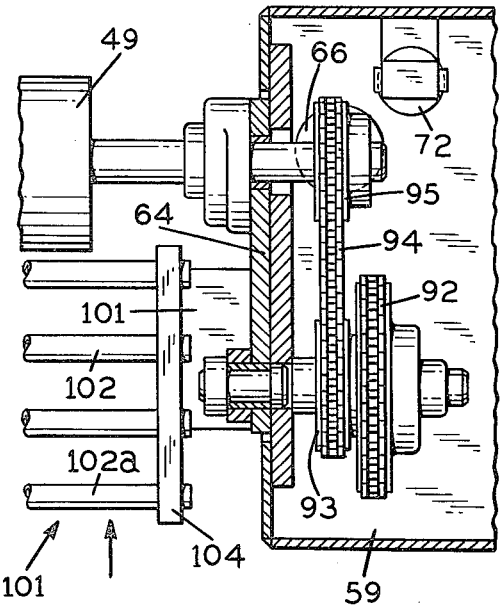

In the illustrated apparatus, the edge drive rolls 26 are driven directly by a variable speed motor (not shown) which establishes the "machine speed". The contact rolls 48, 49 are in turn driven from a speed reducer 80 (FIG. 6) driven off of the edge drive roll input. The output shaft 81 of the reducer 80 is arranged to drive a pair of P.I.V.-type adjustable drives 82, 83, the output shafts 84, 85 of which drive the upper and lower contact rolls 48, 49. The shaft 85 is connected through a chain 86 to a drive sprocket 87 mounted coaxially with the pivot axis of the upper roll supporting lever 70 at one side of the machine (FIG. 8). The sprocket is fixed to a drive pinion 88, which meshes with a gear 89 carried on the roll shaft 68. The P.I.V. output shaft 84, at the opposite side, is connected through sprockets 90, 91 and chain 92 to a drive sprocket 93 mounted coaxially with the pivot axis 65 for the roll-mounting lever 64. The sprocket 93 is connected through a chain 94 and sprocket 95 to the shaft 62 of the lower contact roll 49.

By separate control of the P.I.V. units 82, 83, the contact rolls, 48, 49 may be independently speed regulated, one with respect to the other and also with respect to the edge drive rolls. The calender rolls 37, 38 are also driven from the edge drive roll drive. For this purpose, a variable pulley or the like (not shown) may be provided to control the speed of the calender rolls 37, 38 in relation to the speed of the edge drive rolls, in a generally known manner.

In threading a new length of tubular knitted fabric onto the machine, or when removing or replacing a spreader frame, it is desirable to open the contact rolls 48, 49 with respect to the intervening contact plate 43. This is accomplished by appropriately energizing the actuators 66, 72, extending the upper actuator 72 and retracting the lower actuator 66. As soon as the entry end of the fabric has passed the rollers, the actuators may be reversely energized, to bring the rollers into driving contact with the upper and lower surfaces of the fabric in the manner described.

To prevent entry of foreign objects into the control nip, formed by the contact rollers and the plate 43, an advantageous form of guard arrangement is provided, which bars access to the control nip during normal operation of the machine, but which automatically opens upon opening of the control nip for threading of a new length of fabric. The guard arrangement includes upper and lower guard grids 100, 101, which are arranged respectively above and below the pass line of the fabric. Each grid consists of a series of rods or bars 102 secured at opposite ends and extending transversely across the machine in front of the contact rolls 48, 49. As reflected in FIG. 10, the bars of each grid are arranged and spaced in parallel relation, in a configuration which converges toward the pass line 103 a short distance in front of the contact rolls. In the closed position of the guard, illustrated in full lines in FIG. 10, there is ample space between the forwardmost grid bars 102*a* to accommodate the presence of the upstream end of the spreader frame, but insufficient clearance to admit a large object.

The lower guard grid 101 includes mounting plates 104 at each side, serving to secure the ends of the rods 102 and being in turn fixed to the frame pedestals 58, 59 by bolts 105.

The guard rods 102 of the upper grid 100 are carried at their ends by swing arms 106, which are movably mounted for opening and closing movement. Advantageously, the swing levers 106 are carried on the shaft 68, supporting the upper contact roller 48, the arrangement being such that the shaft 68 rotates within a bushing 107 carried by the swing arm. Portions 108 of the swing arms 106 extend in a downstream direction beyond the shaft 68 and are movably anchored by tie-rods 109, which are pivoted at 110 on the frame pedestals. As reflected particularly in FIG. 10, the geometric relationship of the tie-rods 109 to the swing levers 106 is such that, when the contact roll 48 is in its closed position, illustrated in full lines in FIG. 10, the swing levers 106 are tilted slightly downward in the upstream direction, so that the series of guard rods converges toward the pass line in the upstream direction.

Figure 10:
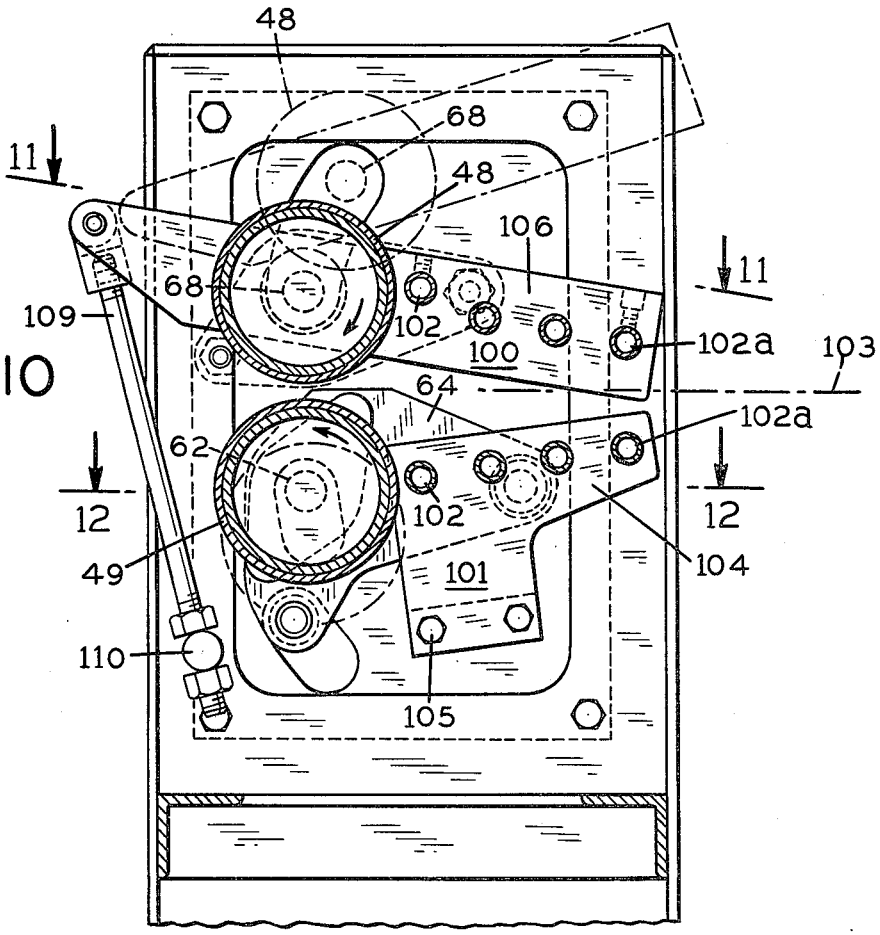

When opening the contact rolls 48, 49, the upper roll 48 is raised on its mounting levers 70, by extension of the fluid actuators 72, such that the upper contact roll 48 assumes the position illustrated in phantom lines in the upper portion of FIG. 10. Since the swing levers 106 are supported by the shaft 68 of the contact roll, the swing levers are raised along with the contact roll. However, the downstream ends 108 of the swing levers are anchored by the tie-rods 109 and serve, in effect, as a moving pivot for the swing levers, such that the forward or upstream portions of the swing levers swing upward through a large arc, to the position shown in phantom lines in FIG. 10, to provide a wide entry opening into the contact roll area.

The method and apparatus of the invention provide a significantly improved arrangement for stripe and cross line control in the finishing of tubular knitted fabric. Of particular significance, in this regard, is the provision of a flat, thin, substantially full-width contact plate, supported within the spreader frame and arranged for cooperation with upper and lower variable speed contact rolls. By using a flat, thin contact plate, rather than internal rolls or the like, significant improvements can be realized in cross line uniformity in the edge areas of the fabric. Thus, in known equipment, utilizing upper and lower stripe control rolls, cooperating with internal, spreader-mounted rolls, significantly large areas of the fabric, at the edge extremities, are not subject to cross line control in the finishing operation and can represent a significantly large geometric discontinuity in a striped fabric, for example. In this respect, where the edge discontinuities are sufficiently large as to be readily noticeable, the basic benefits of the cross line adjustment and control in the center portions of the fabric are largely wasted. In the procedure and apparatus according to the applicant's invention, cross line control is established between a flat, thin contact plate, which is readily accommodated within the cross sectional configuration of a flat, two-layer, laterally distended fabric tube, and a variable speed roller mounted externally of the fabric. The flat contact plate may extend for substantially the full width of the fabric and, indeed, can theoretically extend right up to the wire entry frame. In a typical commercial embodiment, however, a reasonable degree of width adjustment is accommodated by providing a contact plate which is a slightly narrower than the maximum width setting of the spreader for that plate. It is contemplated, in this respect, that any discontinuity in the control contact with the fabric be minimized by the provision of a series of contact plates in increments of about 5 mm.

In some instances, it may be advantageous to provide for positive control contact with the fabric at the edge extremities of the spreader frame. In such cases, an arrangement as shown in FIG. 5 may be utilized. In the modified arrangement, the plate-mounting bracket 140 adjustably receives a contact plate 143 substantially in the manner described with respect to the apparatus of FIGS. 1–4. However, the contact plate 143 is slightly shorter than the plate 43, in a typical case being perhaps 5 cm shorter in length, measured in the transverse direction of the machine. At the side edge extremities of the mounting brackets 140 are auxiliary contact plate sections 143*a*, which are of the same cross section as the primary contact plate 143 but of relatively narrow width, typically about 5 cm measured transversely of the machine. The auxiliary contact plates are permanently secured at each side to the mounting brackets 140, as by means of set screws 111, so as to lie directly alongside the entry frame 45. As in the case of the embodiment of FIGS. 1–4, when the spreader frame is adjusted to a width greater than the minimum width accommodated by the contact plate 143, a narrow gap 144 is formed between the primary contact plate 143 and the auxiliary plates 143*a* at each side. By providing primary contact plates 143 in increments of, say, 5 cm variation in length, the width of the gaps 144 at each side may be limited to a maximum of about 2.5 cm. In any case, however, the gap 144 is displaced inward from the edge extremity, so that direct control contact is provided in the critical area immediately adjacent the entry frame 45.

In either of the forms of the spreader and contact plate arrangement reflected in FIGS. 4 and 5, not only is greatly improved cross line control made possible, but the spreader frame itself is fully adapted for utilization in conventional calendering operations, where stripe control may not be necessary or desirable. Thus, when the contact rolls 48, 49 are separated, the fabric advances in a normal fashion over the spreader frame, being neither distorted nor obstructed by the presence of the contact plate 43.

In addition to utilization in a stripe straightening capacity, the contact rolls 49, 49 may be utilized for overfeeding of tubular knitted fabric to the downstream stage of the spreader. This is accomplished by driving the contact rolls at a higher peripheral speed than that of the edge drive rolls. Additional overfeed capability may be provided by utilizing spreader rolls 24 having relatively deeper than normal grooves for the reception of the edge drive belts 35. With this arrangement, the belts will be advancing at a speed somewhat less than the peripheral speed of the rolls 24, providing some additional overfeed of the fabric in going from the edge drive rolls on to the belts 35.

In any of its forms, the apparatus of the invention may advantageously utilize the improved guard arrangement in association with the contact rolls, enabling the use of such rolls adjacent the upstream or entry end of the spreader without significant risk of injury to a machine operator or to the equipment itself. By supporting the upper guard grid on the upper contact roll itself, an amplified opening motion of the upper guard grid automatically occurs when the upper contact roll is raised, to provide convenient access for threading a new length of fabric, etc.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. Apparatus for processing tubular knitted fabric, which comprises (a) a pair of opposed processing rollers, (b) means for driving said rollers at equal peripheral speeds, (c) a generally flat spreader frame arranged to laterally distend tubular knitted fabric to flat, two-layer form and having a discharge end at the nip formed by said processing rollers, (d) opposed edge drive rolls engaging and supporting said spreader frame by contact with opposed external side edge portions thereof, whereby tubular fabric may be advanced over said spreader frame by said edge drive rolls, (e) first and second opposed contact rolls disposed respectively above and below the spreader frame on the upstream side of said edge drive rolls, (f) flat contact plate means extending substantially the full width of said spreader frame and positioned in opposed relation to said contact rolls, (g) said contact rolls and contact plate means being so related that a single layer of tubular knitted fabric, passing therebetween, is grippingly engaged across the full effective width of the contact plate means by a contact roll, (h) first controllable drive means for driving said edge drive rolls, and (i) second and third controllable drive means for driving said contact rolls at speeds variable with respect to each other and with respect to said edge drive rolls, (j) said spreader, in the immediate region of said contact plate, being of a width to distend said fabric substantially to its full width, (k) said contact plate having an overall thickness not greater than the overall thickness of said spreader frame whereby, in the region of said contact plate, the distance between the two layers of fabric is maintained at a practical minimum.

2. Apparatus according to claim 1, further characterized by (a) said spreader frame including laterally adjustable side frame members, and (b) contact plate mounting members carried by said frame members and having telescopic engagement with said contact plate means.

3. Apparatus according to claim 2, further characterized by (a) said contact plate means comprising a flat, thin plate extending between said plate mounting members, (b) said plate mounting members engaging said plate in downstream edge areas thereof and said plate having contact portions extending upstream from said areas and positioned between said contact rolls.

4. Apparatus according to claim 2, further characterized by (a) said spreader frame including a thin entry frame section extending in an upstream direction from said frame members for guiding the entry of fabric onto said spreader frame, (b) said entry frame including side portions extending along the side edge areas of said contact plate means.

5. Apparatus according to claim 4, further characterized by (a) said entry frame is formed of wire in a generally U-shaped configuration and is anchored and supported by said contact plate mounting members.

6. Apparatus according to claim 1, further characterized by (a) said contact plate means being telescopically supported at each side in the opposite sides of said spreader frame, (b) said spreader frame being expandable and contractable in width through a limited range with respect to said contact plate means.

7. Apparatus according to claim 6, further characterized by (a) said spreader frame including a thin entry frame section extending along the side edges of said contact plate means and in an upstream direction therefrom, (b) said entry frame being expandable and contractable in width through said limited range and being movable toward and away from the side edges of said contact plate means.

8. Apparatus for processing tubular knitted fabric, which comprises (a) a pair of opposed processing rollers, (b) means for driving said rollers at equal peripheral speeds, (c) a spreader frame arranged to laterally distend tubular knitted fabric to flat, two-layer form and having a discharge end at the nip formed by said processing rollers, (d) opposed edge drive rolls engaging and supporting said spreader frame by contact with opposed external side edge portions thereof, whereby tubular fabric may be advanced over said spreader frame by said edge drive rolls, (e) first and second opposed contact rolls disposed respectively above and below the spreader frame on the upstream side of said edge drive rolls, (f) flat contact plate means extending substantially the full width of said spreader frame and positioned in opposed relation to said contact rolls, (g) said contact rolls and contact plate means being so related that a single layer of tubular knitted fabric, passing therebetween, is grippingly engaged across the full effective width of the contact plate means by a contact roll, (h) first controllable drive means for driving said edge drive rolls, (i) second and third controllable drive means for driving said contact rolls at speeds variable with respect to each other and with respect to said edge drive rolls, (j) said contact plate means being telescopically supported at each side in the opposite sides of said spreader frame, (k) said spreader frame being expandable and contractable in width through a limited range with respect to said contact plate means, (l) said spreader frame including a thin entry frame section extending along the side edges of said contact plate means and in an upstream direction therefrom, (m) said entry frame being expandable and contractable in width through said limited range and being movable toward and away from the side edges of said contact plate means, and (n) auxiliary contact plate means mounted on said spreader frame adjacent said entry frame, (o) said auxiliary contact plate means being movable with said entry frame during expansions and contractions in the width thereof and being movable laterally with respect to said contact plate means, (p) said auxiliary contact plate means forming in effect a lateral continuation of the contact plate means.

9. Apparatus for processing tubular knitted fabric, which comprises (a) a generally flat spreader frame arranged to receive tubular knitted fabric and to distend it to flat, two-layer form at a predetermined width, (b) said spreader frame including spaced, opposed, width-adjustable side frame members, (c) means for advancing tubular knitted fabric over said frame at a controllable rate, (d) a thin, flat contact plate extending between said side frame members, (e) a pair of transversely disposed contact rolls positioned above and below said contact plate and extending for at least the full width of said spreader frame, (f) said contact rolls being adjustable with respect to said contact plate whereby a layer of fabric passing between the plate and a contact roll is grippingly engaged by said roll over substantially the full width of the plate, and (g) means for controllably rotating said contact rolls at speeds variable with respect to each other and with respect to the advancing means, (h) said spreader, in the immediate region of said contact plate, being of a width to distend said fabric substantially to its full width, (i) said contact plate having an overall thickness not greater than the overall thickness of said spreader frame whereby, in the region of said contact plate, the distance between the two layers of fabric is maintained at a practical minimum.

10. Apparatus according to claim 9 further characterized by (a) drive belts extending along the side edge extremities of said spreader frame, (b) the upstream ends of said drive belts commencing at a point downstream of said contact rolls.

11. Apparatus according to claim 10, further characterized by (a) edge drive rolls engaging and supporting said spreader frame at a point downstream of said contact rolls.

12. Apparatus according to claim 9, further characterized by (a) said spreader frame being laterally adjustable for varying the predetermined width of processed fabric, (b) said contact plate being of fixed width and being telescopically connected to said side frame members.

13. Apparatus for processing tubular knitted fabric, which comprises (a) a spreader frame arranged to receive tubular knitted fabric and to distend it to flat, two-layer form at a predetermined width, (b) said spreader frame including spaced, opposed, width-adjustable side frame members, (c) means for advancing tubular knitted fabric over said frame at a controllable rate, (d) a thin, flat contact plate extending between said side frame members, (e) a pair of transversely disposed contact rolls positioned above and below said contact plate and extending for at least the full width of said spreader frame, (f) said contact rolls being adjustable with respect to said contact plate whereby a layer of fabric passing between the plate and a contact roll is grippingly engaged by said roll over substantially the full width of the plate, (g) means for controllably rotating said contact rolls at speeds variable with respect to each other and with respect to the advancing means, p1 (h) said spreader frame being laterally adjustable for varying the predetermined width of processed fabric, (i) said contact plate being of fixed width and being telescopically connected to said side frame members, and (j) auxiliary contact plate members mounted on and movable with said side frame members and forming, in effect, a lateral continuation of said contact plate at each end, (k) said auxiliary contact plate members being laterally movable with respect to said contact plate.

* * * * *